US007269949B1

(12) United States Patent
Petricio Yaksic

(10) Patent No.: US 7,269,949 B1
(45) Date of Patent: Sep. 18, 2007

(54) SYNCHRONIZING HYDRAULIC CYLINDERS

(76) Inventor: Davor Petricio Yaksic, La Colpa 681, Sector la Chimba, Casilla 902, Antofagasta (CL)

( * ) Notice: Subject to any disclaimer, the term of this patent is extended or adjusted under 35 U.S.C. 154(b) by 0 days.

(21) Appl. No.: 11/165,299

(22) Filed: Jun. 24, 2005

Related U.S. Application Data

(63) Continuation-in-part of application No. 10/948,172, filed on Sep. 24, 2004.

(51) Int. Cl.
*F15B 7/00* (2006.01)

(52) U.S. Cl. ..... 60/546; 91/171; 100/258 R

(58) Field of Classification Search ..... 60/546; 91/171; 100/258 R
See application file for complete search history.

(56) References Cited

U.S. PATENT DOCUMENTS 2,283,447 A * 5/1942 MacMillin et al. ..... 100/258 R
2,302,132 A * 11/1942 MacMillin et al. ..... 100/258 R
3,768,400 A * 10/1973 Gygli et al. ..... 100/258 R
3,855,794 A * 12/1974 Meyer et al. ..... 60/546
4,192,222 A * 3/1980 Dits ..... 91/171
4,230,304 A 10/1980 Tol
4,624,126 A 11/1986 Avila et al.
4,784,058 A 11/1988 Nakagawa et al.
4,832,315 A 5/1989 Vanderklaauw
4,873,923 A 10/1989 Manning
5,013,011 A 5/1991 Halloway
5,065,844 A 11/1991 Hon
5,156,782 A 10/1992 Ballantyne
5,735,201 A 4/1998 Hirao et al.

* cited by examiner

*Primary Examiner*—F. Daniel Lopez
(74) *Attorney, Agent, or Firm*—James Creighton Wray

(57) ABSTRACT

Synchronizing hydraulic cylinders is provided by interconnected double-acting cylinders with dual pistons and central dividers which, with the pistons, divide the cylinders into four chambers. The outer chambers drive the pistons and the loads attached to the piston rods. The inversely interconnected intermediate inner chambers synchronize and balance piston and load movement. In double piston divided cylinders opposite outer chambers move a connected load and reversely connected inner chambers synchronize the load.

18 Claims, 8 Drawing Sheets

SYNCHRONIZING HYDRAULIC CYLINDERS

This application is a continuation-in-part of application Ser. No. 10/948,172 filed Sep. 24, 2004, which is hereby incorporated by reference in its entirety.

BACKGROUND OF THE INVENTION

When using hydraulic cylinders for moving a linear element or a plane with uneven loads, the piston rods connected to lightly loaded parts tend to move further.

Needs exist for synchronization of piston movements.

SUMMARY OF THE INVENTION

Synchronizing hydraulic cylinders is provided by interconnected double-acting cylinders with dual pistons and central dividers which, with the pistons, divide each of the cylinders into four chambers. The outer chambers drive the pistons and the loads attached to the piston rods. The inversely interconnected intermediate inner chambers synchronize and balance piston and load movement.

A three-way valve is moved to connect a pump to the upper chambers and to connect a sump tank to the lower chambers for driving the piston rods and a load connected to the ends of the piston rods away from the cylinders. Moving the three-way valve to an opposite position connects the pump to the lower chambers and the sump to the upper chambers for driving the piston rods and the load toward the cylinders. Movement of the pistons is synchronized by oppositely interconnecting the intermediate inner chambers. A valve at the center of the interconnections to the intermediate chambers may be opened to disable the synchronizing. That allows one piston rod to move further than the other piston rod. Opening the valve to disable the intermediate chamber synchronizing and allowing one of the pistons to move further than the other, and then closing the valve, establishes a new relationship of the piston rods. The piston movement is synchronized with different extensions of the piston rod with equal movement applied by the piston rods after the interconnected load is skewed.

Multiple interconnections of opposite intermediate inner chambers synchronize movement of four piston rods, which may be connected to points in a movable plane. Valves in the interconnections between the opposite intermediate inner chambers may be opened to allow intentional tipping of the plane. When the valves are opened and the plane is tipped and then the valves are closed, parts of the tipped plane will move synchronously in the tipped condition of the plane. The cylinders and interconnections may also be used with multiple pistons having rods connected to one or more linear elements for synchronous movement.

The interconnecting of opposite intermediate inner chambers in three piston six-chamber cylinders and two-piston four-chamber cylinders synchronize movement of piston rods. Valves between the cylinders may be opened to disable the synchronizing, or may be opened and closed to resume synchronizing after tilting of the structure connected to the piston rods. If the structure is to be permanently tilted, the synchronized cylinders may be mounted in parallel tipped relationship so that available piston travels are equal.

Synchronized cylinders connected to small or large apparatus such as planar or linear structures, press brakes or wing flaps, for example, are used to uniformly move the small or large apparatus.

In another embodiment, pairs of two double-acting cylinder are connected in opposition to each other at ends of beams or corners of planes. Two double-action hydraulic pistons are mounted in axial pairs. Each pair has inner chambers connected in inverse disposition to attain synchronization of the two pistons at opposite ends of a beam or plane. Constructing each chamber is also possible by connecting two normal double-action pistons oppositely, one for opening and one for closing. Connecting the inner chambers of two equal systems in the opposite way achieves a satisfactory result.

The invention provides a method of synchronizing piston movement between or among hydraulic cylinders attached to an object to be moved. Each mover or actuator has at least two interconnected pistons and at least four chambers. The two interconnected pistons in each actuator move together in the chambers. Supplying hydraulic fluid to first chambers in the cylinders moves the pistons. The hydraulic fluid is supplied to the first chambers at first ends of the actuator. Hydraulic fluid is drained to a sump tank from second chambers at opposite ends of the cylinders. Moving the pistons in the cylinders transfers hydraulic fluid from an intermediate chamber in one cylinder to an opposite intermediate chamber in a remote cylinder and transfers hydraulic fluid from a different intermediate chamber in the remote cylinder to an opposite intermediate chamber in the first cylinder.

Disabling the transferring of hydraulic fluid between opposite intermediate chambers occurs by opening a valve to communicate passageways between the intermediate chambers, and to allow fluid to flow indiscriminately between the intermediate inner chambers.

In one embodiment, the cylinders are first and second cylinders. Each of the cylinders has first and second chambers at opposite ends of the cylinders. The intermediate inner chambers are third and fourth chambers on opposite sides of central dividers within the cylinders. The transferring transfers fluid between the third chamber of the first cylinder and the fourth chamber of the second cylinder and transfers fluid between the third chamber of the second cylinder and the fourth chamber of the first cylinder. When one piston rod tends to move further than the other, the transferring tends to retard advancement of that piston rod and tends to promote the advancement of the other piston rod so that both piston rods move equally, irrespective of their load forces.

The synchronizing comprises increasing hydraulic pressure in the intermediate inner third chamber upon travel of a first piston in the first cylinder for enlarging the first chamber and compressing the third chamber. That transfers the increased pressure from the third chamber of the first cylinder to the fourth chamber of the second cylinder for applying additional force to the piston in the second cylinder.

Valves are provided between the pump and the sump tank and the first and second chambers in the cylinders. The valves connect the first chambers at first ends of the cylinders to the pump and connect the second chambers to the sump tank for moving the piston away from the first chambers. Moving the valves connects the pump to the second chambers and connects the first chambers to the sump tank for moving the pistons in the cylinders toward the first ends of the cylinders.

Preferably the valves are incorporated in a three-way valve for alternately connecting the pump and sump tank to the first and second chambers. The pump is connected to the first chambers and the sump tank to the second chambers in a first position of the valve. The pump and the sump tank are connected and the chambers are disconnected from the pump and the sump tank in a second position of the valve. The pump is connected to the second chambers, and the first chambers are connected to the sump tank in a third position of the three-way valve.

One embodiment provides additional cylinders having two chambers and communicates hydraulic fluid between intermediate inner chambers of the main cylinders and opposite intermediate chambers of the auxiliary cylinders.

Another embodiment has multiple cylinders with multiple pistons interconnected in a piston assembly in each cylinder. A piston rod shaft extends from each cylinder for driving a load. Each cylinder has a first chamber at one end for connecting to a pump and driving the piston assembly in a direction toward the second chambers. Connecting the pump to the second chambers moves the piston assemblies toward the first chambers. Communicating hydraulic fluid among the cylinders between opposite intermediate chambers in the cylinders synchronizes movements of the piston rod.

In that form with four cylinders each has a piston assembly with three interconnected pistons. Each of the cylinders has two dividers equally spaced from each other and from the opposite ends of the cylinders for cooperating with the pistons in the piston assemblies and dividing the each of the cylinders into six chambers. The first and second chambers are at opposite ends of the cylinders. The second, third, fourth and fifth intermediate inner chambers are sequentially arranged between the first and second chambers. The intermediate inner chambers are cross-communicated for synchronizing piston assembly movement. The second chamber of a first cylinder communicates with a third chamber of a second cylinder. A second chamber of a third cylinder interconnects with a third chamber of a fourth cylinder. A fourth chamber of the first cylinder interconnects with a fifth chamber of the third cylinder. A fourth chamber of the third cylinder communicates with a fifth chamber of the first cylinder. A fourth chamber of the second cylinder interconnects with a fifth chamber of the fourth cylinder. A fourth chamber of the fourth cylinder is connected with the fifth chamber of the second cylinder for moving the piston assemblies synchronously.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
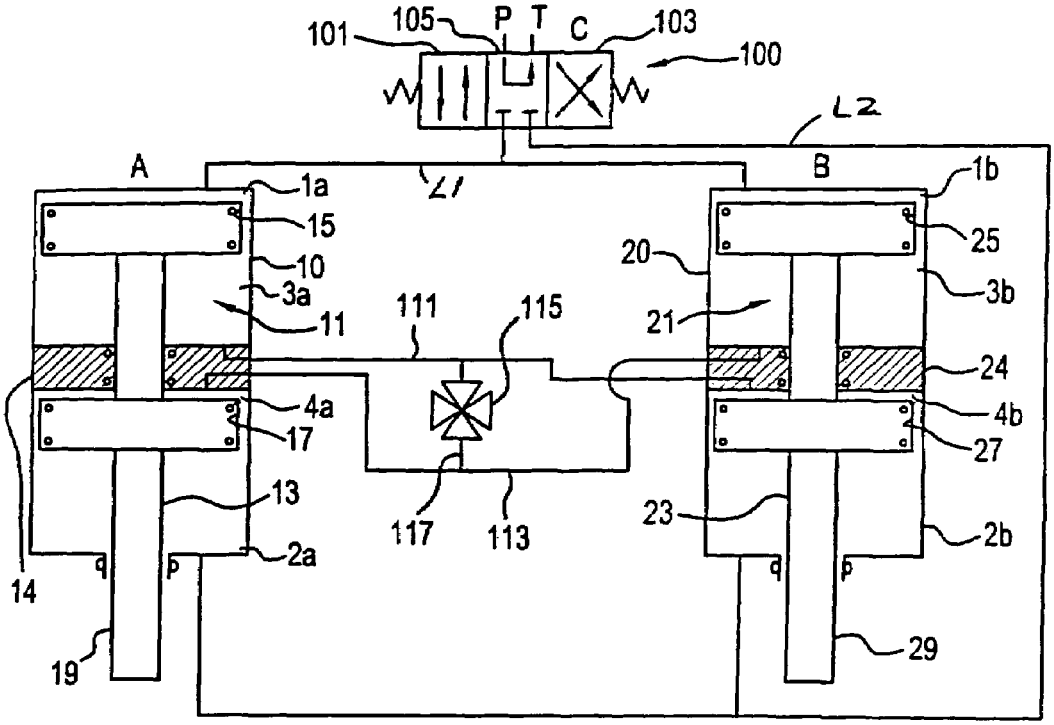
FIG. 1 schematically shows interconnected double-acting cylinders with dual pistons and central dividers which, with the pistons, divide the cylinders into four chambers. The outer chambers drive the pistons and the loads attached to the pistons, and the intermediate inner chambers synchronize and balance piston and load movement.

FIG. 1 shows interconnected double-acting cylinders A and B, 10 and 20 with dual piston assemblies 11, 21 with piston rods 13, 23 and central dividers 14, 24. The pistons 15, 17, 25, 27 and the dividers divide each of the cylinders into four chambers 1*a*, 2*a*, 3*a*, 4*a*, 1*b*, 2*b*, 3*b*, 4*b*. The outer chambers 1, 2*a*, 1*b*, 2*b* drive the piston assemblies 11, 21 and the load (not shown) attached to the piston rod extended shafts 19, 29. The intermediate inner chambers 3*a*, 4*a*, 3*b*, 4*b* synchronize and balance piston and load movement. A hydraulic pump P is connected by a three-way valve 100 to either the upper chambers 1*a*, 1*b* by line 1 L1, or to the lower chambers 2*a*, 2*b* by line 2 L2. The opposite outer chambers are connected to a sump tank T. Moving the valve 100 into position 101 connects the pump P to chambers 1*a* and 1*b* and the sump T to chambers 2*a* and 2*b* to drive the piston assemblies downward. Position 103 provides the opposite connection to drive the piston assemblies upward. In the central position 105 shown in FIG. 1, the system is inactive.

Synchronization of the movements of the piston rod shafts 19, 29 is accomplished by cross-connecting the inner chambers 3*a* to 4*b*, and 4*a* to 3*b*, as shown in FIG. 1. Line 111 connects chambers 3*a* to 4*b*. Line 113 connects chambers 4*a* and 3*b*. That interconnection occurs when valve 115 is closed. Valve 115 in line 117 may be opened to disable the synchronization by allowing hydraulic fluid to flow freely between the inner chambers. When valve 115 is open, either shaft 19 or 29 may be moved relative to the other to tip the device connected to the shafts. When valve 115 is closed with the shafts 19 and 29 misaligned, the equalizing chambers are cross-connected to maintain that intentional misalignment. Reopening the valve 115 allows realignment of the shafts, and closing valve 115 holds the new alignment and activates the equalizing cross-connections of the inner cylinders.

Figure 2:
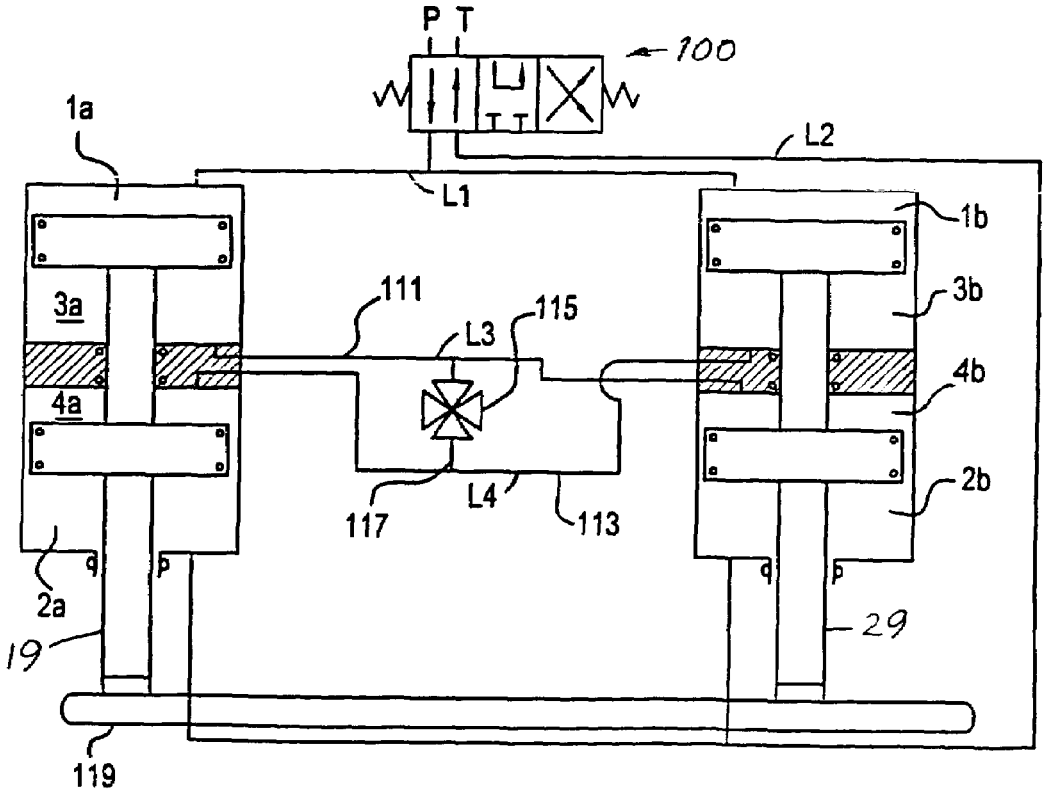
FIG. 2 schematically shows an embodiment similar to FIG. 1, with a three-position valve moved to connect a pump to the upper chamber and a sump tank to the lower chambers for driving the piston rods and a load connected to the ends of the piston rods away from the cylinders while synchronizing movement of the pistons by oppositely interconnecting the intermediate inner chambers. The valve at the center of the interconnections of the intermediate chamber may be opened to disable the synchronizing and to allow one piston rod to move further than the other piston rod. Opening the valve to disable the intermediate chamber synchronizing and allowing one of the pistons to move further than the other, and then closing the valve, synchronizes the piston movement with different extensions of the piston rod with equal force applied by the piston rods after the interconnected load is skewed.

FIG. 2 shows an embodiment similar to FIG. 1, with the three-way valve 100 moved to position 101 to connect pump P to line L1 and the upper chambers 1*a*, 1*b* and a sump tank T to line L2 and the lower chambers 2*a*, 2*b* for driving the piston rods 19 and 29 and a load 119 connected to the ends of the piston rods away from the cylinders 10, 20. Synchronizing movement of the piston assemblies 11, 21 is accomplished by oppositely interconnecting the intermediate inner chambers 3*a* to 4*b* with line 111, 4*a* to 3*b* through line 113. The valve 115 at the center of the interconnecting liens 111, 113 of the intermediate chambers may be opened to disable the synchronizing and to allow one piston rod 19 or 29 to move further than the other piston rod 29 or 19, tipping load 119. Opening the valve 115 to disable the intermediate chamber synchronizing and allowing one of the pistons to move further than the other, and then closing the valve, synchronizes the piston assembly movement with different extensions of the piston rods 19, 29 with equal travel by the piston rods 19, 29 after the interconnected load 119 is skewed.

In FIG. 2, when the position of the three-way valve makes the fluid flow from the pump to chambers 1*a* and 1*b* and the fluid from chambers 2*a* and 2*b* to the tank, the fluid from chamber 3*a* flows to chamber 4*b*, and the fluid from chamber 3*b* flows to chamber 4*a*. If the fluid cannot be compressed, the quantity of fluid passing between chambers 3*a*, 4*b* and 4*a* 3*b* must be equal, or the system cannot move. If the volumes and areas are equal, the piston will move the same distance in each direction. This condition changes if the bypass valve between lines 111 and 113 is open. In that case, the pistons will not move equally. The bypass is useful for moving the pistons into different relative positions. When the bypass is shut, pistons move synchronously.

Figure 3:
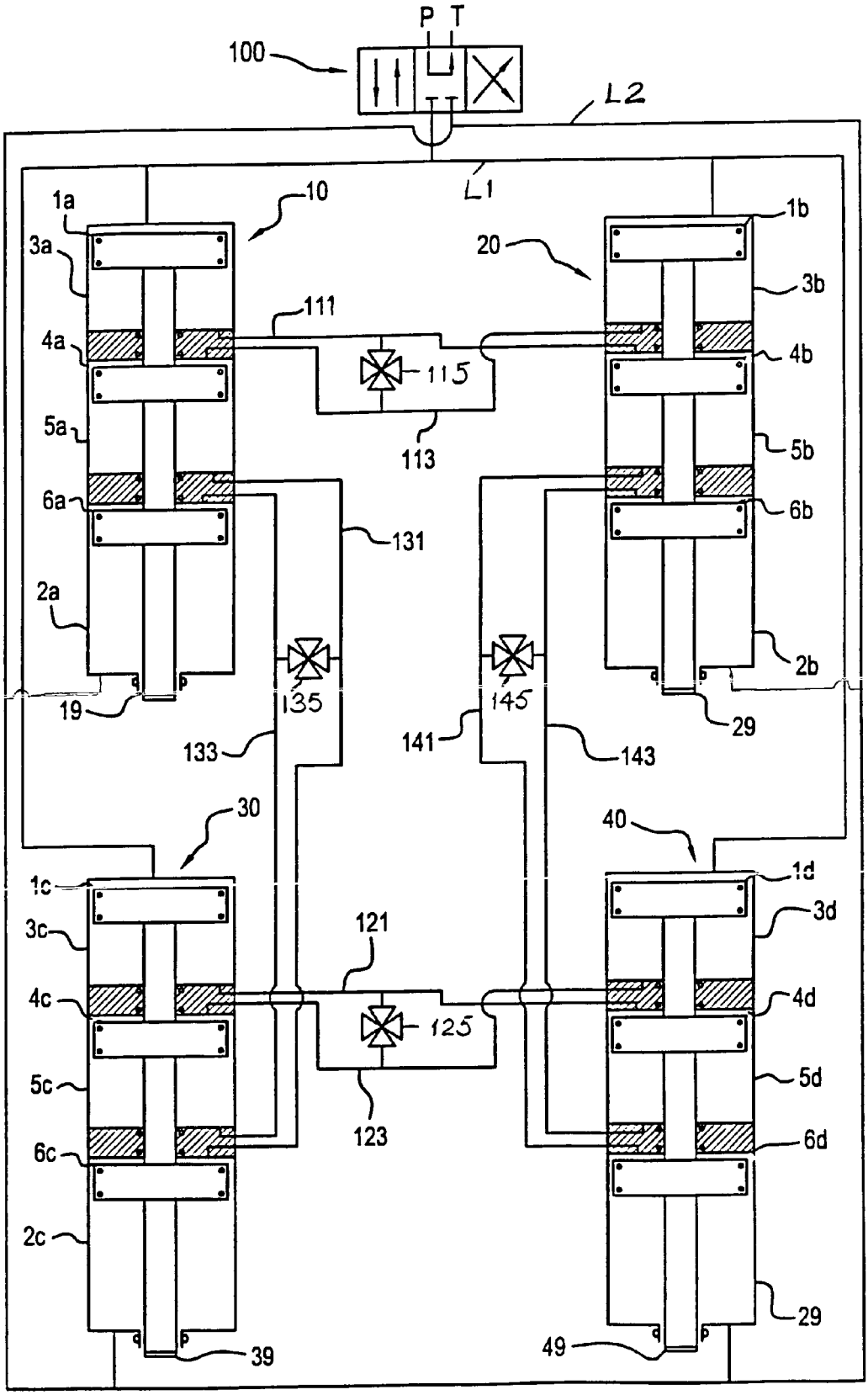
FIG. 3 schematically shows the interconnecting of intermediate inner chambers in four triple piston chambers synchronizing movement of four piston rods such as may be connected to points in a movable plane or prints in a single line. Valves in the interconnections of the intermediate inner chambers allow intentional tipping of the plane upon opening the valve. When the valve is opened and the plane may be tipped, and when the valve is closed, parts of the tipped plane will move synchronously. Valves may be omitted when translating the plane without tipping. The cylinders and interconnections of FIG. 3 may also be used with multiple pistons having rods connected to one or more linear elements for synchronous movement.
Figure 4:
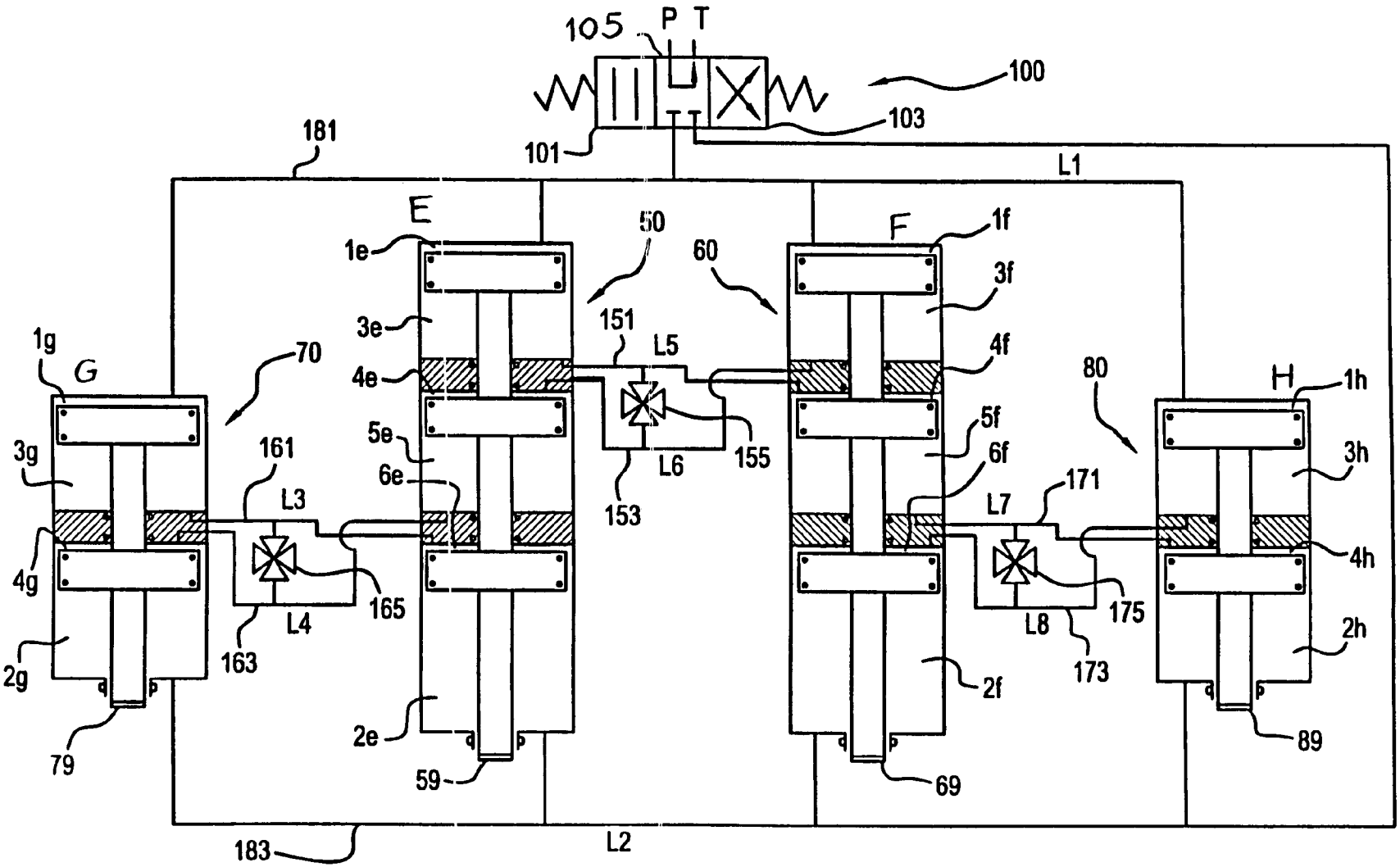
FIG. 4 schematically shows the interconnecting of opposite chambers in three piston six chamber cylinders and two piston four chamber cylinders for synchronizing movement of piston rods. The valves depicted between the cylinders may be opened to disable the synchronizing, or may be opened and closed to provide synchronizing after tilting of the structure connected to the piston rods.

It is also possible to make more than two pistons work in synchronization by adding inner chambers, always in twos alternating diagonally in interconnections. Pistons can be put in line as shown in FIG. 4, or in a plane, as shown in FIG. 3. In the first case, as shown in FIG. 4, a line joining the center of the pistons will move in parallel up and down. In the second case, as shown in FIG. 3, if the pistons are moving a flat surface, the flat surface will move in parallel up and down.

FIG. 3 shows the interconnecting of intermediate inner chambers 3–6*a*, 3–6*b*, 3–6*c* and 3–6*d* for synchronizing movement of four piston rods 19, 29, 39, 49 in four cylinders 10, 20, 30, 40 such as may be connected to points in a movable plane. Valves 115, 125, 135 and 145 respectively in the interconnections 111, 113, 121, 123, 131, 133, 141, 143 of the intermediate inner chambers may be provided to allow intentional tipping of the plane that is connected to ends of rods 19, 29, 39 and 49 upon opening the valves. When the valves are opened and the plane is tipped and then the valves are closed, all parts of the tipped plane will move synchronously. The cylinders and interconnections of FIG. 3 may also be used with multiple pistons having rods 19, 29, 39, 49 connected to one or more linear elements for synchronous movement.

FIG. 4 schematically shows the interconnecting of opposite chambers in three-piston six-chamber cylinders E and F, 50, 60 and two-piston four-chamber cylinders G and H, 70, 80 for synchronizing movement of piston rods 59, 69, 79 and 89. The valves 155, 165, 175 depicted between the cylinders 50, 60, 70, 80 may be opened to disable the synchronizing, or may be opened and closed to provide synchronizing after tilting of the structure connected to the piston rods 59, 69, 79 and 89.

Line 151 connects chambers 3*e* and 4*f*. Line 153 connects 3*f* with 4*e*. Line 161 connects 5*e* with 4*g*. Line 161 connects 6*e* with 3*g*. Line 163 connects 4*g* with 5*e*. Line 171 connects chambers 5*f* and 4*h*. Line 173 connects 6*f* with 3*h*.

Moving three-way valve 100 to the end position 101 connects pump P through line 181 to chambers 1*e*, 1*f*, 1*g* and 1*h* and connects sump T through line 183 to chambers 2*e*, 2*f*, 2*g* and 2*h* for moving piston rods 59, 69, 79, 89, downward.

Moving three-way valve 100 to end position 103 connects pump P with line 183 and chambers 2*e*, 1*f*, 1*g* and 1*h*.

Sump T is connected through line 181 to chambers 1*e, f, g* and *h* to raise the piston rods and the attached load.

Figure 5:
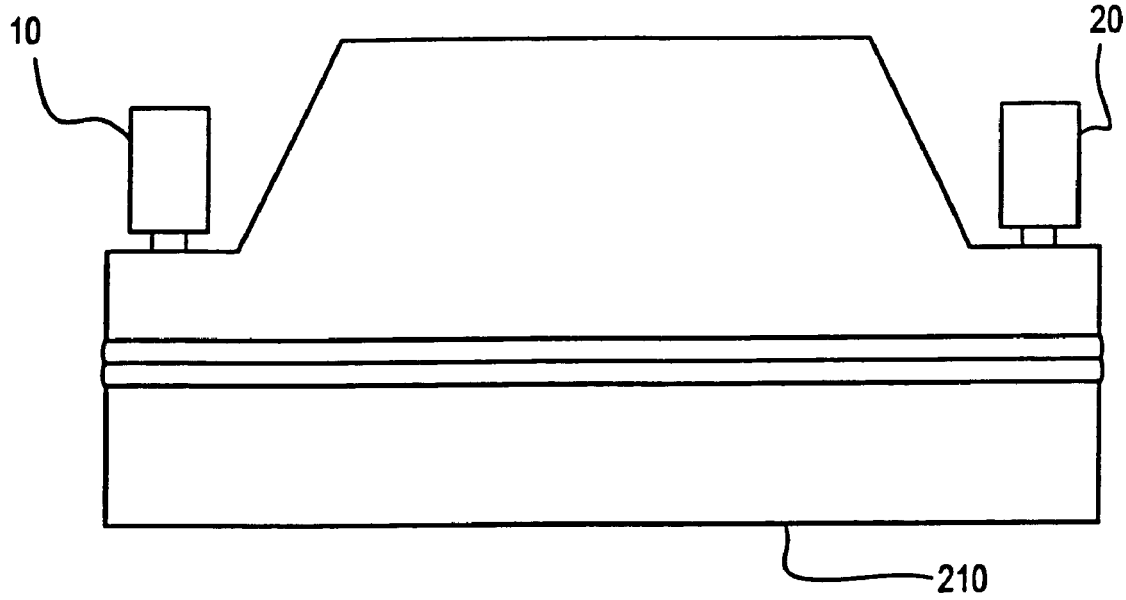
FIGS. 5 and 6 schematically show connections of synchronized cylinders to large heavy-duty apparatus such as a press brake.

FIG. 5 schematically shows connections of synchronized cylinders 10 and 20 to large heavy-duty apparatus such as a press brake 210.

Figure 6:
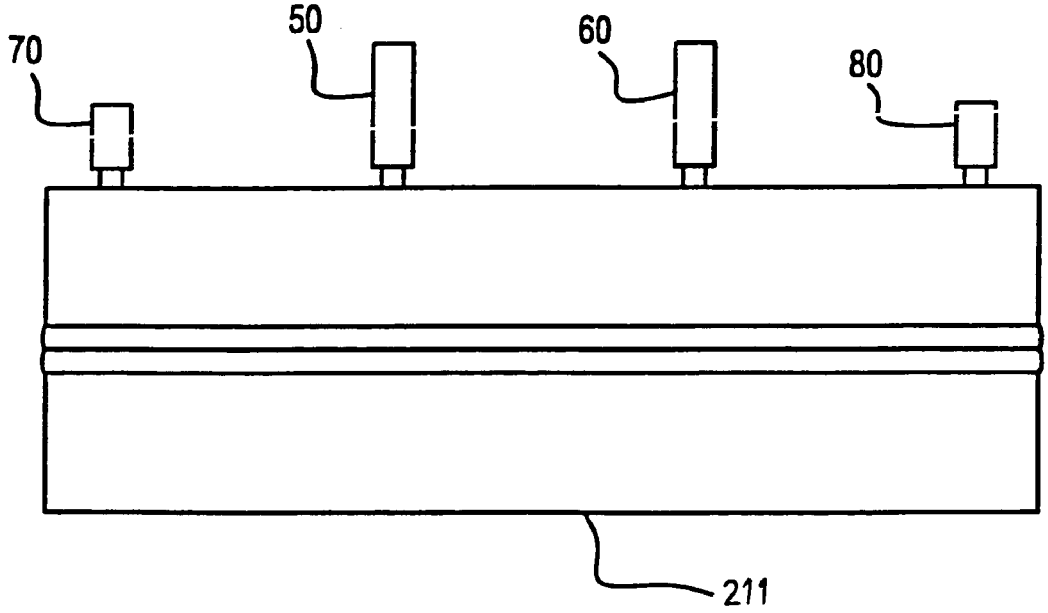

FIG. 6 schematically shows connections of synchronized cylinders 50, 60, 70 and 80, as shown in FIG. 4, to large heavy-duty apparatus such as a press brake 211.

Figure 7:
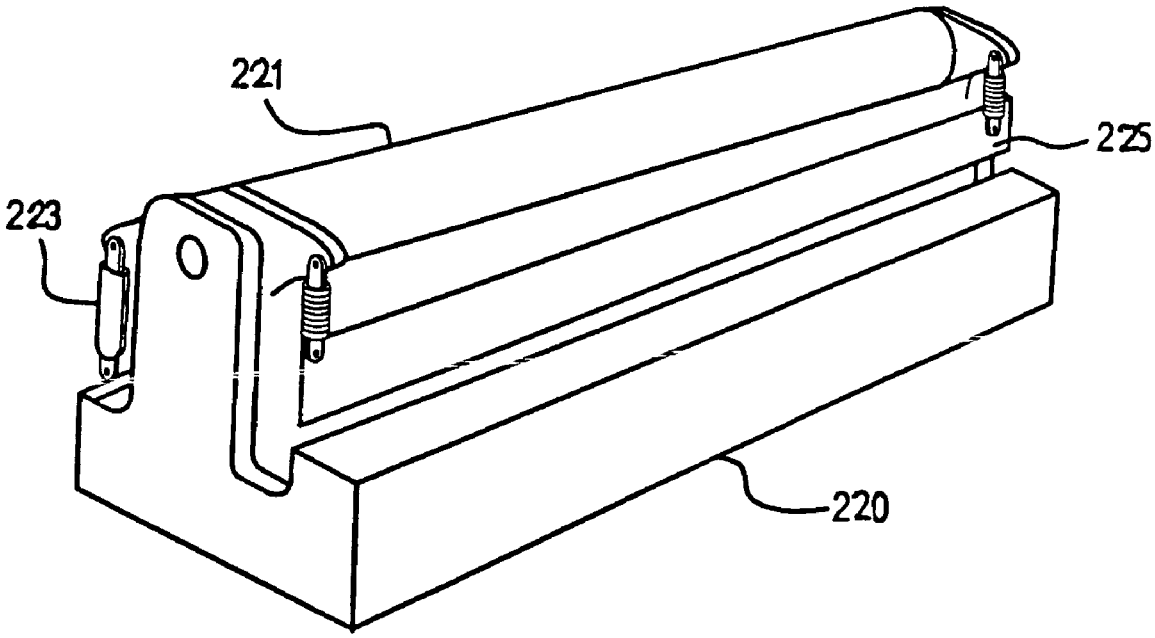
FIG. 7 shows a heavy-duty press brake with a heavy rocker interposed between cylinders and a blade of a press brake for mechanically constraining equal piston movement.

FIG. 7 shows a heavy-duty prior art press brake 220 with a heavy rocker 221 interposed between cylinders 223 and a blade 225 of a press brake for mechanically constraining equal piston movement. The hydraulic synchronization of the present invention may replace a heavy rocker arm because less torque is applied.

Synchronizing hydraulic cylinders in the present invention is provided by interconnected double-acting cylinders with dual pistons and central dividers. The pistons and the dividers divide the cylinders into four chambers, as shown in FIGS. 1 and 2. The outer chambers drive the pistons and the load attached to the piston rods. The inversely interconnected intermediate inner chambers synchronize piston and load movement.

A three-way valve is moved to connect a pump to the upper chambers and a sump tank to the lower chambers for driving the piston rods and a load connected to the ends of the piston rods away from the cylinders. Movement of the pistons is synchronized by oppositely interconnecting the intermediate inner chambers. A valve at the center of the interconnections to the intermediate chambers may be opened to disable the synchronizing. That allows one piston rod to move further than the other piston rod. Opening the valve to disable the intermediate chamber synchronizing and allowing one of the pistons to move further than the other, and then closing the valve, establishes a new relationship of the piston rods. The new piston movement is synchronized with different extensions of the piston rod with equal movement applied by the piston rods after the interconnected load is skewed.

Multiple interconnections of opposite intermediate inner chambers synchronize movement of four piston rods, as shown in FIG. 3, which may be connected to points in a movable plane. Valves between the interconnections between the opposite intermediate inner chambers may be opened to allow intentional tipping of the plane. When the valves are opened and the plane is tipped and then the valves are closed, parts of the tipped plane will move synchronously in the tipped condition of the plane. The cylinders and interconnections may also be used with multiple pistons having rods connected to one or more linear elements, such as shown in FIG. 4, for synchronous movement.

The interconnecting of opposite intermediate inner chambers in three-piston six-chamber cylinders and two-piston four-chamber cylinders synchronizes movement of piston rods. Valves in lines between inner synchronizing chambers of the cylinders may be opened to disable the synchronizing, or may be opened and closed to resume synchronizing after tilting of the load structure connected to the piston rods. If the structure is to be permanently tilted, the synchronized cylinders may be mounted in parallel sloped relationship so that available piston travels are equal.

Synchronized cylinders connected to small or large apparatus such as planes or linear structures, for example press brakes or wing flaps, are used to concurrently move parts of the small or large apparatus.

Figure 8:
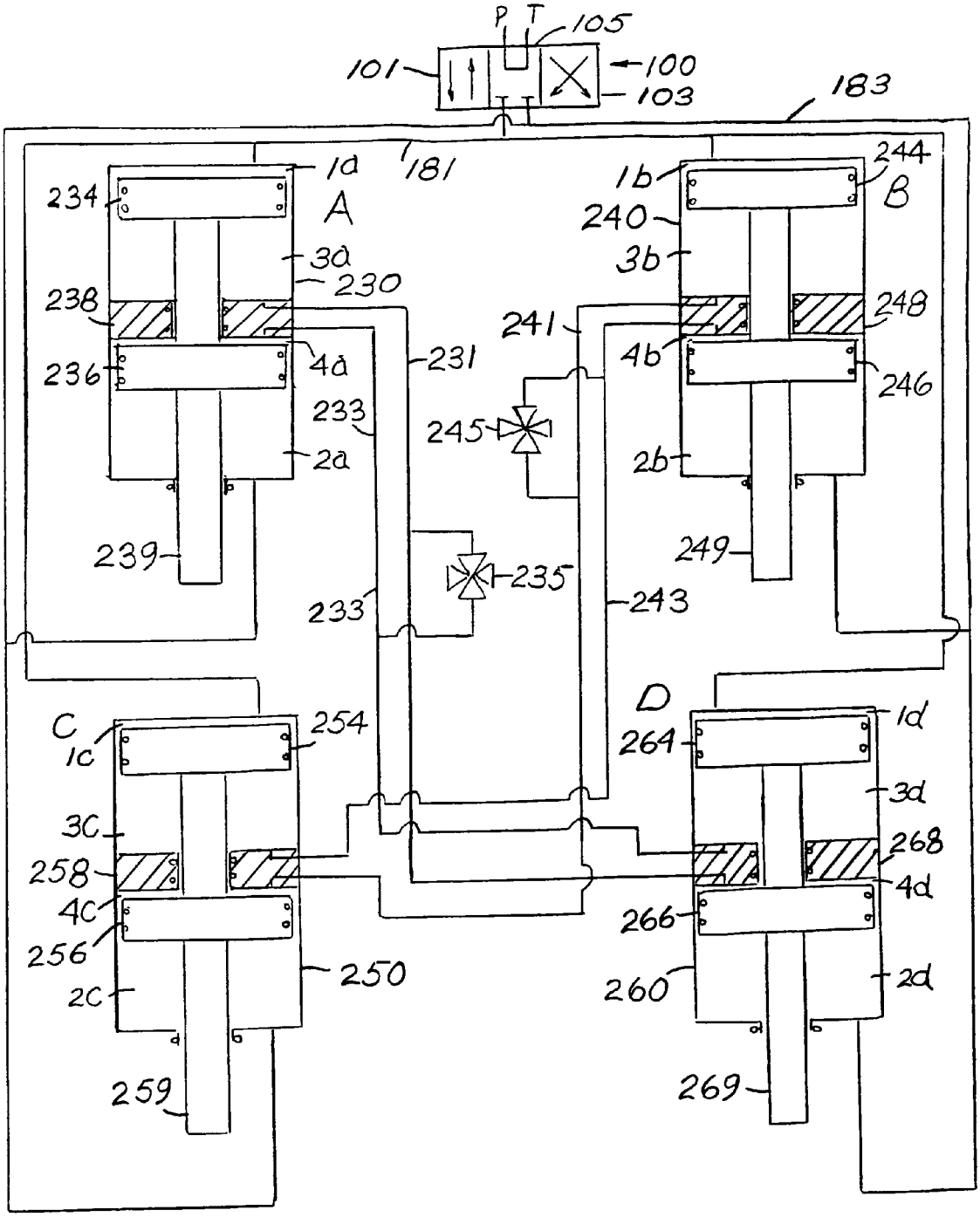
FIG. 8 schematically shows the interconnecting of intermediate inner chambers in four double piston chambers synchronizing movement of four piston rods such as may be connected to points in a movable plane or prints in a single line.

FIG. 8 shows the interconnecting of intermediate inner chambers 3*a*, 4*a* to 4*d* and 3*d*, and 3*b*, 4*b* to 4*c* and 3*c* for synchronizing movement of four piston rods 239, 249, 259, 269 in four cylinders 230, 240, 250, 260 such as may be connected to points in a movable plane. Cylinders 230 . . . 260 have double pistons 234, 244, 254 . . . 264 and 236, 246, 256 . . . 266 on opposite sides of dividers 238, 248, 258 . . . 268. Valves 235, 245, when opened, interconnect lines 231 with 233 and 241 with 243 to the intermediate inner chambers to allow intentional tipping of the plane that is connected to ends of rods 239, 249, 259 and 269 upon opening the valves. When the valves are opened and the plane is tipped and then the valves are closed, all parts of the tipped plane will move synchronously. The cylinders and interconnections of FIG. 8 may also be used with multiple pistons having rods 239, 249, 259, 269 connected to one or more linear elements for synchronous movement.

Figure 9:
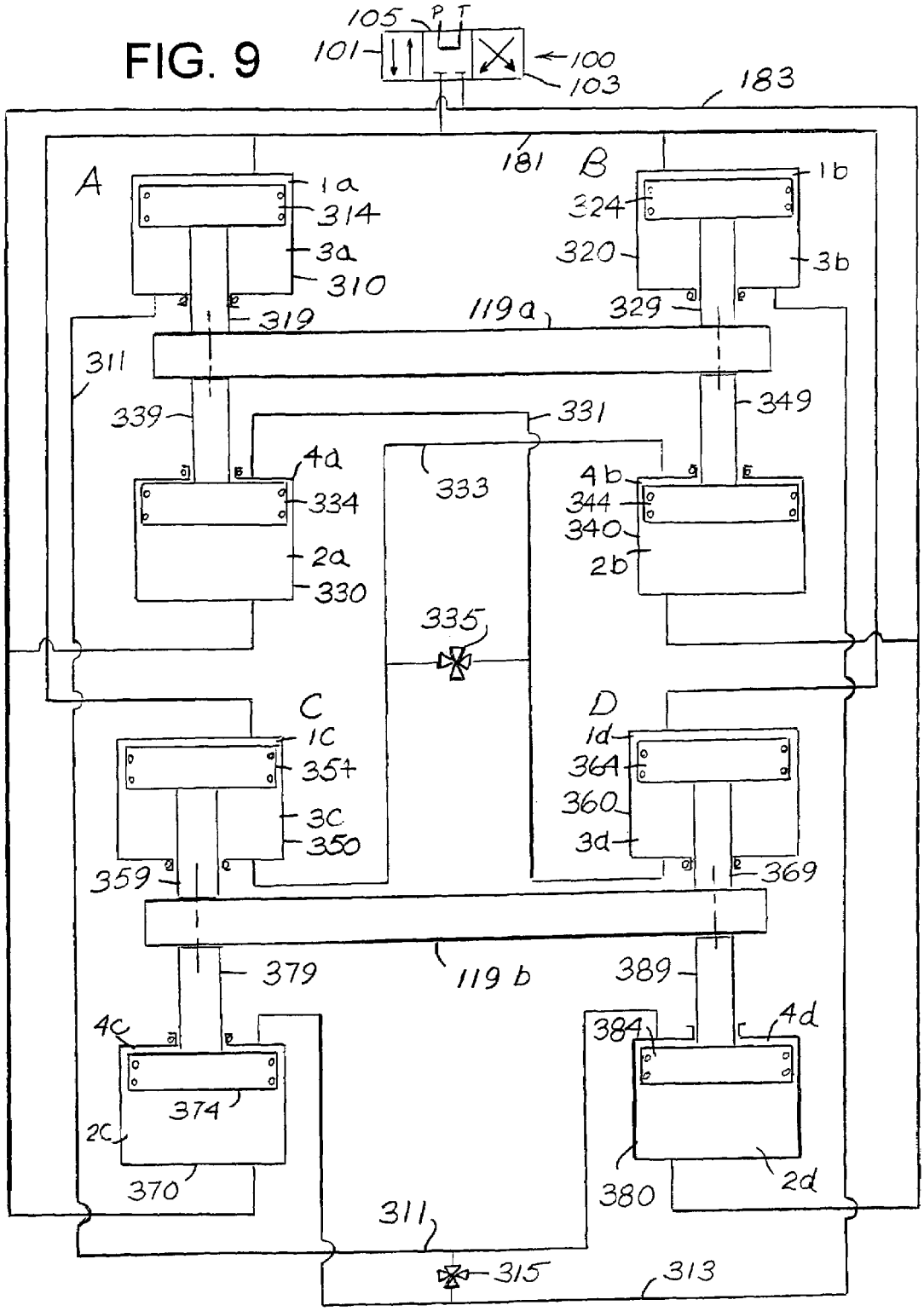
FIG. 9 schematically shows the interconnecting of intermediate inner chambers in eight double-acting single piston chambers synchronizing movement of eight piston rods such as may be connected to points in a movable plane or prints in a single line.

FIG. 9 schematically shows the interconnecting of opposite inner chambers in eight single-piston double-acting cylinders 310, 330, 320, 340, 350, 370 and 360, 380 for synchronizing movement of piston rods 319, 329, 339, 349, 359, 369, 379 and 389. Single pistons 314 . . . 384 are disposed in the cylinders, dividing each cylinder into two variable volume chambers. The valves 315, 335 connected between lines connecting inner chambers of the double-acting cylinders may be opened to disable the synchronizing, or may be opened and closed to provide synchronizing after tilting of the structure connected to the piston rods 339–389.

Line 311 connects chambers 3*a* and 4*d*. Line 313 connects chambers 3*b* and 4*c*. Line 331 connects chamber 4*a* with 3*d*. Line 333 connects chambers 4*b* and 3*c*.

In FIG. 9, moving three-way valve 100 to the end position 101 connects pump P through line 181 to chambers 1*a*, 1*b*, 1*c* and 1*d* and connects sump T through line 183 to chambers 2*a*, 2*b*, 2*c* and 2*d* for moving piston rods 319, 329, 359 and 369 downward.

Moving three-way valve 100 to end position 103 connects pump P with line 183 and chambers 2*a*, 2*b*, 2*c* and 2*d*.

Sump T is connected through line 181 to chambers 1*a*, 1*b*, 1*c* and 1*d* to raise the piston rods and the attached load.

Figure 10:
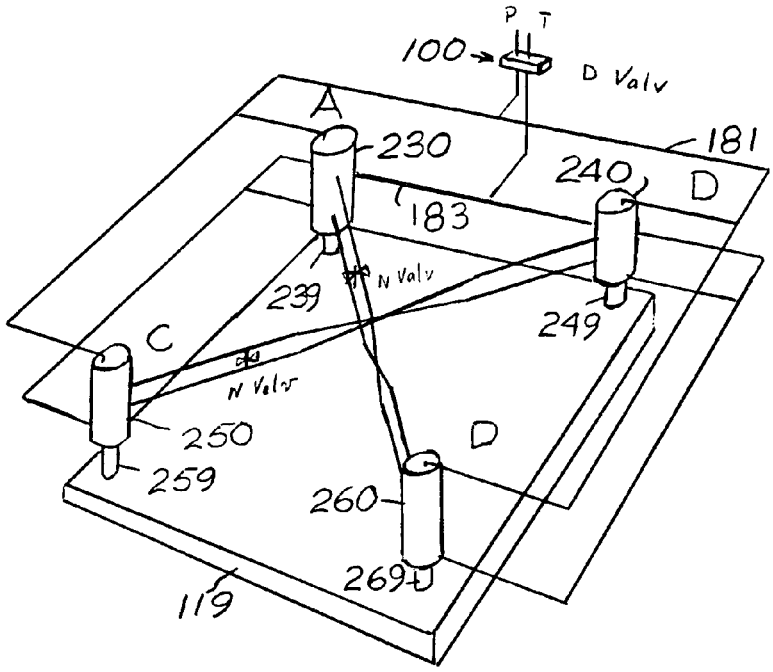
FIG. 10 schematically shows an arrangement of cylinders such as shown in FIG. 8 on a plate for moving the plate and pistons synchronously.

FIG. 10 schematically shows connections of synchronized cylinders 230, 240, 250 and 260 to large heavy-duty plate or press platen 119.

Figure 11:
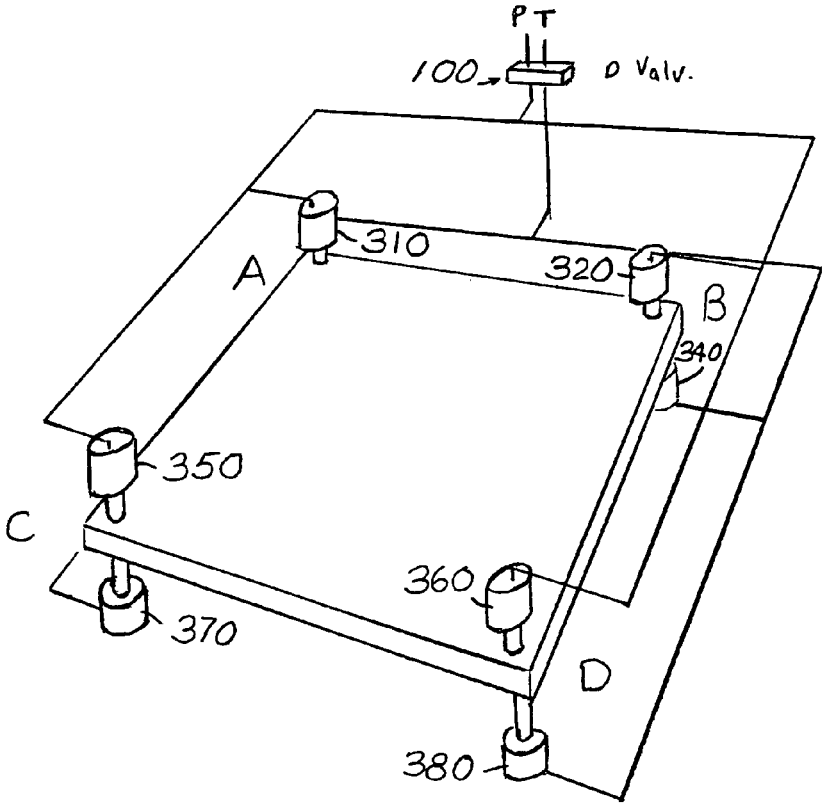
FIG. 11 schematically shows an arrangement of cylinders such as shown in FIG. 9 on a plate for moving the plate and pistons synchronously.

FIG. 11 schematically shows connections of synchronized cylinders 310, 320, 330, 340, 350, 360, 370 and 380 to large heavy-duty plate apparatus such as a press platen 119.

Inner chambers of the cylinders mechanically constrain equal piston movement. The hydraulic synchronization of the present invention may replace a heavy rocker arm.

Synchronizing hydraulic cylinders in the present invention is provided by interconnected inner chambers in double-acting cylinders with pistons and piston rods. The pistons and the dividers divide the cylinders into four chambers, as shown in FIG. 8. The outer chambers drive the pistons and the load attached to the piston rods. The inversely interconnected intermediate inner chambers synchronize pistons and the load movement.

In FIG. 9 eight double-acting single-piston cylinders are connected in pairs in mutual opposition to move the load up or down.

A three-way valve is moved to connect a pump to the upper chambers and to connect a sump tank to the lower chambers for driving the piston rods and a load connected to the ends of the piston rods away from the cylinders. Movement of the pistons is synchronized by oppositely interconnecting the intermediate inner chambers. A valve at the center of the interconnections to the intermediate chambers may be opened to disable the synchronizing. That allows one piston rod to move further than the other piston rod. Opening the valve to disable the intermediate chamber synchronizing and allowing one of the pistons to move further than the other and then closing the valve, establishes a new relationship of the piston rods. The new piston movement is synchronized with different extensions of the piston rod with equal movement applied by the piston rods after the interconnected load is skewed.

Multiple interconnections of opposite intermediate inner chambers synchronize movement of four piston rods, as shown in FIG. 8, or eight piston rods as shown, which may be connected to points in a movable plane. Valves connecting the interconnections between the opposite intermediate inner chambers may be opened to allow intentional tipping of the plane. When the valves are opened and the plane is tipped and then the valves are closed, parts of the tipped plane will move synchronously in the tipped condition of the plane. The cylinders and interconnections may also be used with multiple pistons having rods connected to one or more linear elements for synchronous movement.

The interconnecting of opposite intermediate inner chambers in the four two-piston four-chamber cylinders and eight oppositely paired one-piston two-chamber cylinders synchronizes movement of piston rods. Valves in lines between inner synchronizing chambers of the cylinders may be opened to disable the synchronizing, or may be opened and closed to resume synchronizing after tilting of the load structure connected to the piston rods. If the structure is to be permanently tilted, the synchronized cylinders may be mounted in parallel sloped relationship so that available piston travels are equal.

Synchronized cylinders connected to small or large apparatus such as planes or linear structures, for example plates, press platens, press brakes or wing flaps, are used to concurrently move parts of the small or large apparatus.

While the invention has been described with reference to specific embodiments, modifications and variations of the invention may be constructed without departing from the scope of the invention, which is defined in the following claims.

The invention claimed is:

1. A method of synchronizing piston movement in hydraulic cylinders, comprising providing hydraulic cylinders, each cylinder having at least two pistons and at least four chambers, and connecting the at least two pistons in each cylinder for movement together in the chambers, supplying hydraulic fluid to first chambers in first ends in the cylinders, and moving the pistons with the hydraulic fluid supplied to the first chambers at the first ends of the cylinders, draining hydraulic fluid from second chambers at opposite second ends of the cylinders to a sump tank; and moving the pistons in the cylinders, transferring hydraulic fluid from a third, inner intermediate chamber in a first cylinder to an opposite fourth, inner intermediate chamber in a second cylinder and transferring hydraulic fluid from a third, inner intermediate chamber in the second cylinder to an opposite fourth, inner intermediate chamber in the first cylinder.

2. The method of claim 1, further comprising disabling the transferring of hydraulic fluid between opposite intermediate chambers by opening a valve to communicate passageways between the intermediate chambers.

3. The method of claim 1, wherein the cylinders comprise first and second cylinders, and wherein the third and fourth chambers are on opposite sides of a central division within the cylinders.

4. The method of claim 3, wherein the synchronizing comprises increasing hydraulic pressure in the third inner intermediate chamber in the first cylinder upon travel of a first piston in the first cylinder for enlarging the first chamber and compressing the third chamber, and transferring the increased pressure from the third chamber of the first cylinder to the fourth chamber of the second cylinder for moving the pistons in the second cylinder.

5. The method of claim 1, further comprising providing a pump and a sump tank, providing a valve between the pump and the sump tank and the first and second chambers in the cylinders, and alternatively connecting the first chambers at first ends of the cylinders to the pump, and connecting the second chambers to the sump tank for moving the pistons away from the first chambers, and moving the valves for connecting the pump to the second chambers and connecting the first chambers to the sump tank for moving the pistons in the cylinders toward the first ends of the cylinders.

6. The method of claim 5, wherein the valve is in a three-position valve for alternately connecting the pump to the first chambers and the sump tank to the second chambers in a first position of the three-position valve, for connecting the pump to the sump tank and disconnecting the chambers from the pump and the sump tank in a second position, and for connecting the pump to the second chambers and connecting the first chambers to the sump tank in a third position of the three-position valve.

7. The method of claim 1, wherein the providing of hydraulic cylinders comprises providing additional cylinders having four chambers and communicating hydraulic fluid between chambers of the main cylinders and opposite intermediate chambers of the auxiliary cylinders.

8. A method of synchronizing, comprising providing multiple cylinders with multiple pistons interconnected in a piston assembly in each cylinder and a piston rod shaft extending from each cylinder for moving a load, the cylinders having first chambers at first ends for connecting to a pump and driving the piston assemblies in a direction compressing second chambers at second ends of the cylinders, and for connecting the pump to the second chambers and the sump to the first chambers for moving the piston assemblies toward the first chambers, the cylinders each having at least two inner intermediate chambers and communicating hydraulic fluid among the cylinders between opposite intermediate chambers in the cylinders, wherein the cylinders comprise four cylinders, wherein each piston assembly comprises three interconnected pistons, wherein each of the cylinders has two dividers equally spaced from each other and from the opposite ends of the cylinders for cooperating with the pistons in the piston assemblies and dividing the each of the cylinders into six chambers, with first and second chambers at opposite ends of the cylinders and with third, fourth, fifth and sixth intermediate inner chambers between the first and second chambers, and wherein the communicating the intermediate chambers comprises interconnecting the third chamber of a first cylinder with a fourth chamber of a second cylinder, interconnecting a fourth chamber of the first cylinder with a third chamber of the second cylinder, interconnecting a third chamber of the fourth cylinder with a fourth chamber of the third cylinder, interconnecting a third chamber of a third cylinder with a fourth chamber of a fourth cylinder, and interconnecting a sixth chamber of the first cylinder with a fifth chamber of the third cylinder, interconnecting a sixth chamber of the third cylinder with a fifth chamber of the First cylinder, and interconnecting a sixth chamber of the second cylinder with a fifth chamber of the fourth cylinder and a sixth chamber of the fourth cylinder with the fifth chamber of the second cylinder for moving the piston assemblies sequentially.

9. A method of synchronizing, comprising providing multiple cylinders with multiple pistons interconnected in a piston assembly in each cylinder and a piston rod shaft extending from each cylinder for moving a load, the cylinders having first chambers at first ends for connecting to a pump and driving the piston assemblies in a direction compressing second chambers at second ends of the cylinders, and for connecting the pump to the second chambers and the sump to the first chambers for moving the piston assemblies toward the first chambers, the cylinders each having at least two inner intermediate chambers and communicating hydraulic fluid among the cylinders between opposite intermediate chambers in the cylinders, wherein the cylinders comprise first, second, third and fourth cylinders, wherein the third and fourth cylinders each have two pistons and four chambers, and connect the two pistons in each cylinder for movement together in the third and fourth chambers, wherein each piston assembly in first and second cylinders comprises three interconnected pistons, wherein each of the first and second cylinders has two dividers equally spaced from each other and from the opposite ends of the cylinders for cooperating with the pistons in the piston assemblies and dividing the each of the first and second cylinders into six chambers, with first and second chambers at opposite ends of all os the cylinders and with third, fourth, fifth and sixth intermediate inner chambers between the first and second chambers in the first and second cylinders, and wherein the communicating the intermediate chambers comprises interconnecting the third chamber of a first cylinder with a fourth chamber of a second cylinder, interconnecting a fourth chamber of the first cylinder with a third chamber of the second cylinder, and interconnecting a sixth chamber of the first cylinder with a third chamber of the third cylinder, interconnecting a fourth chamber of the third cylinder with a fifth chamber of the first cylinder, and interconnecting a sixth chamber of the second cylinder with a third chamber of the fourth cylinder and a fourth chamber of the fourth cylinder with the fifth chamber of the second cylinder for moving the piston assemblies sequentially.

10. A method of synchronizing, comprising providing multiple cylinders with multiple pistons interconnected in a piston assembly in each cylinder and a piston rod shaft extending from each cylinder for moving a load, the cylinders having first chambers at first ends for connecting to a pump and driving the piston assemblies in a direction compressing second chambers at second ends of the cylinders, and for connecting the pump to the second chambers and the sump to the first chambers for moving the piston assemblies toward the first chambers, the cylinders each having at least two inner intermediate chambers and communicating hydraulic fluid among the cylinders between opposite intermediate chambers in the cylinders.

11. The method of claim 10, wherein the multiple cylinders comprise first and second cylinders, and wherein each of the first and second cylinders has first and second chambers at opposite ends of the cylinder, and wherein the intermediate chambers are third and fourth chambers on opposite sides of a central division within the cylinders, wherein the transferring further comprises transferring fluid between the third chamber of the first cylinder and the fourth chamber of the second cylinder and transferring fluid between the third chamber of the second cylinder and the fourth chamber of the first cylinder.

12. The method of claim 10, wherein the multiple cylinders comprise main cylinders, wherein the providing of hydraulic cylinders further comprises providing additional cylinders, each additional cylinder including first chambers at first ends, second chambers at second ends, and inner intermediate chambers between the first and second chambers having four chambers and communicating hydraulic fluid between further opposite intermediate chambers of the main cylinders and the opposite intermediate chambers of the auxiliary cylinders.

13. A method of synchronizing piston movement in hydraulic cylinders, comprising providing four hydraulic cylinders, each cylinder having a central divider, two pistons on opposite sides of the divider, and at least four chambers, and connecting the at least two pistons in each cylinder for movement together in the chambers, supplying hydraulic fluid to first chambers in the cylinders, draining hydraulic fluid from second chambers at opposite ends of the cylinders to a sump tank, and moving the pistons with the hydraulic fluid supplied to the first chambers at first ends of the cylinders, transferring hydraulic fluid from an intermediate chamber in a first cylinder to an opposite intermediate chamber in a second cylinder and providing hydraulic fluid from a different intermediate chamber in the second cylinder to an opposite intermediate chamber in the first cylinder, transferring hydraulic fluid from an intermediate chamber in a third cylinder to an opposite intermediate chamber in a fourth cylinder and providing hydraulic fluid from a different intermediate chamber in the fourth cylinder to an opposite intermediate chamber in the third cylinder.

14. The method of claim 13, further comprising disabling the transferring of hydraulic fluid between the opposite intermediate chambers by opening valves to communicate hydraulic fluid in passageways between the intermediate chambers.

15. The method of claim 13, wherein the cylinders comprise first, second, third and fourth cylinders, and wherein each of the cylinders has the first and second chambers at opposite ends of the cylinder, and wherein the intermediate chambers are the third and fourth chambers on opposite sides of the central dividers within the cylinders, wherein the first and third and second and fourth chambers are on opposite sides of the pistons within the chambers, wherein the transferring further comprises transferring fluid between the third chamber of the first cylinder and the fourth chamber of the second cylinder and transferring fluid between the third chamber of the second cylinder and the fourth chamber of the first cylinder, and transferring fluid between the third chamber of the third cylinder and the fourth chamber of the fourth cylinder and transferring fluid between the third chamber of the fourth cylinder and the fourth chamber of the third cylinder.

16. A method of synchronizing, comprising providing multiple double-acting single piston cylinders in opposed pairs with opposite pistons connected to piston rods extending from the cylinders to spaced positions on a load for moving a load, the opposed pairs of cylinders having first chambers at first ends and second chambers at second opposite ends of the pairs of cylinders, and having third and fourth inner intermediate chambers on inner surfaces of the pistons in the opposed pairs of cylinders for connecting the first chambers to a pump and driving the pistons in a direction compressing the second and third chambers and for connecting the pump to the second chambers and the sump to the first chambers for moving the pistons toward the first chambers, and compressing the first and fourth chambers, the cylinders each having communication between opposite ones of the inner intermediate chambers and communicating hydraulic fluid among the cylinders between the opposite intermediate chambers in the paired cylinders.

17. The method of claim 16, wherein the cylinders comprise first, second, third and fourth paired cylinders, wherein two piston rods connect the two pistons in each paired cylinder to opposite points on a load for movement together.

18. The method of claim 17, wherein the load is a large heavy duty plate or platen.

* * * * *